United States Patent [19]

St. Armand

[11] Patent Number: 5,038,411

[45] Date of Patent: Aug. 13, 1991

[54] BREAST-FEEDING COVER AND SHOULDER CLIP

[76] Inventor: Susan St. Armand, 4518 Winding Brook Dr., Bensalem, Pa. 19020

[21] Appl. No.: 580,851

[22] Filed: Sep. 11, 1990

[51] Int. Cl.[5] ..... A41D 1/20; A41D 1/22

[52] U.S. Cl. ..... 2/104; 2/46; 224/201; 224/265

[58] Field of Search ..... 2/49 R, 46, 48, 69, 2/87, 88, 94, 104; 224/201, 901, 265, 266

[56] References Cited

U.S. PATENT DOCUMENTS

| | | | |
|---|---|---|---|
| 890,164 | 8/1908 | Culver . | |
| 1,206,480 | 11/1916 | Stagg . | |
| 2,717,437 | 9/1955 | De Mestral | 2/DIG. 6 |
| 3,528,699 | 7/1985 | Hughes . | |
| 3,884,403 | 5/1975 | Brewer | 224/901 X |
| 3,940,040 | 2/1976 | Haulter | 224/201 X |
| 4,220,302 | 9/1980 | Hampton et al. | 224/901 X |
| 4,468,816 | 9/1984 | Kaufer | 2/104 |
| 4,566,136 | 11/1986 | Echols . | |
| 4,567,611 | 2/1986 | Kendrick . | |
| 4,601,068 | 7/1986 | Frechette . | |
| 4,631,754 | 12/1986 | Ryan . | |
| 4,651,349 | 3/1987 | Heiler | 2/104 |
| 4,660,227 | 4/1987 | Abramson . | |
| 4,712,251 | 12/1987 | Cobble . | |
| 4,953,770 | 9/1990 | Bond, Sr. | 224/901 X |
| 4,989,268 | 2/1991 | Stohland | 2/104 |

*Primary Examiner*—Werner H. Schroeder
*Assistant Examiner*—Jeanette E. Chapman
*Attorney, Agent, or Firm*—Mathews, Woodbridge & Collins

[57] ABSTRACT

A breast-feeding garment includes a cover and a pliable shoulder clip attachable to the cover for giving the cover stability. The shoulder clip includes a back shoulder engaging portion connected to a front shoulder engaging portion by an internal deformable wire. The triangularly-shaped cloth cover includes a firm, soft extension pad in one corner which helps to spread the cover. Hook and loop fastening means are employed to attach the front shoulder engaging portion of the shoulder clip to the soft extension pad of the cover. The cover is formed from a see-through, breathable fabric but includes an opaque privacy portion near the center for concealing the breast-feeding child. When not in use, the garment folds up and fits neatly into a carrying bag which can be tied to a stroller, diaper bag, purse or the like.

6 Claims, 4 Drawing Sheets

BREAST-FEEDING COVER AND SHOULDER CLIP

BACKGROUND OF THE INVENTION

1. Field of the Invention

This invention relates to a stabilized breast-feeding garment including a cover for concealing the nursing child and a deformable clip attachable to the cover for engaging the shoulder of the mother.

2. Description of Related Art

Mastering the art of discreet breast-feeding in public has long been a struggle for women. Many inventors have tried to make the job of discreet breast-feeding easier. While all prior art devices are directed primarily at concealing the breast area, the approaches usually require special wardrobes, shoulder drapes or blankets, all of which in turn have created new problems of their own.

When special clothing has to be purchased to breast-feed an infant, it can be a substantial expense, especially for new parents. Examples of prior art garments designed to be worn as items of clothing include those described in the following U.S. Pat. Nos.: 890,614; 1,206,480, 4,528,699; 4,566,136; 4,567,611; 4,601,068 and 4,660,227.

Another prior art approach is to employ a garment that is not disguised as an item of clothing but rather acts as a drape to cover the nursing child. The advantage of drapes is that they are less expensive than specialty clothing but tend to slip and be unstable. Also, prior art drapes may work for mothers who nurse only while sitting, but other mothers may be more active, especially those with additional children, and may need the ability to walk around.

One prior art solution has been to use a plain fabric shoulder blanket. Unfortunately, shoulder blankets slip and may cause a mother and child to feel overheated and uncomfortable.

Alternatively, drapes can be made to fit around the neck of the mother, as described in U.S. Pat. No. 4,631,754 or over or around the shoulder of the mother as described in U.S. Pat. Nos. 4,468,816 and 4,712,251.

The device described in U.S. Pat. No. 4,712,251 is of possible relevance in that it includes a portion that rests over the shoulder of the wearer and is connectable to a front bib. The device relies on an equal distribution of weight to keep the bib in position. Such an approach may work for sitting mothers but, unfortunately, it does not provide sufficient stability for a nursing mother who is standing up or walking around. Under such circumstances, the bib has a tendency to slide off the mother's shoulder.

It was in the context of the foregoing prior art that the present invention arose.

SUMMARY OF THE INVENTION

Briefly described, the invention comprises a breast-feeding garment that includes a triangularly-shaped front cover and a pliable shoulder clip. The shoulder clip includes a padded shoulder engaging section attached to an elongated front shoulder engaging section which extends over the shoulder of the wearer. A pliable, deformable wire internally connects the front and back shoulder engaging portions. The clip, including the deformable wire, can be bent to conform to any shoulder size and it will remain that way until manually bent again.

The cover has a triangular shape and includes an extension pad at its apex which causes the cover to spread open for wider coverage. Hook and loop fasteners are employed to releasably connect the extension pad to the front shoulder engaging portion of the clip. The purpose of the releasable fastener is to enable the mother to place the cover in the most desirable position and to permit easy cleaning of the cover separate from the clip, if desired. A lightweight, semi-transparent and breathable fabric is preferably employed for the cover to encourage the circulation of fresh air to the nursing infant. An opaque privacy cover or portion is attached to and located approximately in the center of the lightweight cover to conceal the location where the child nurses the exposed breast.

When not in use, the garment, including the shoulder clip and cover, can be rolled up and placed into a carrying bag which the mother can attach to a diaper bag, purse, stroller or the like.

These and other features of the invention will be more fully understood by reference to the following drawings.

DETAILED DESCRIPTION OF THE INVENTION

During the course of this description, like numbers will be used to identify like elements according to the different views that illustrate the invention.

Figure 1:
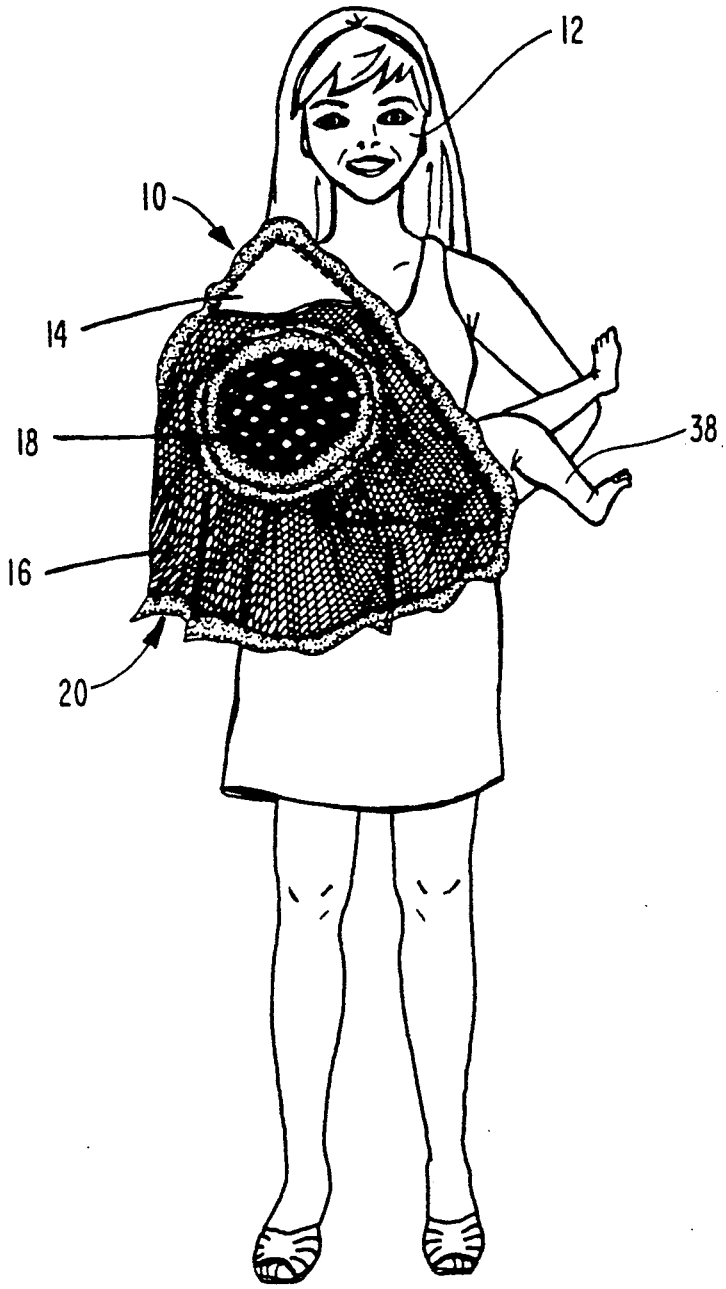
FIG. 1 is a front perspective view of the preferred embodiment of the breast-feeding garment as worn by a standing, nursing mother.
Figure 2:
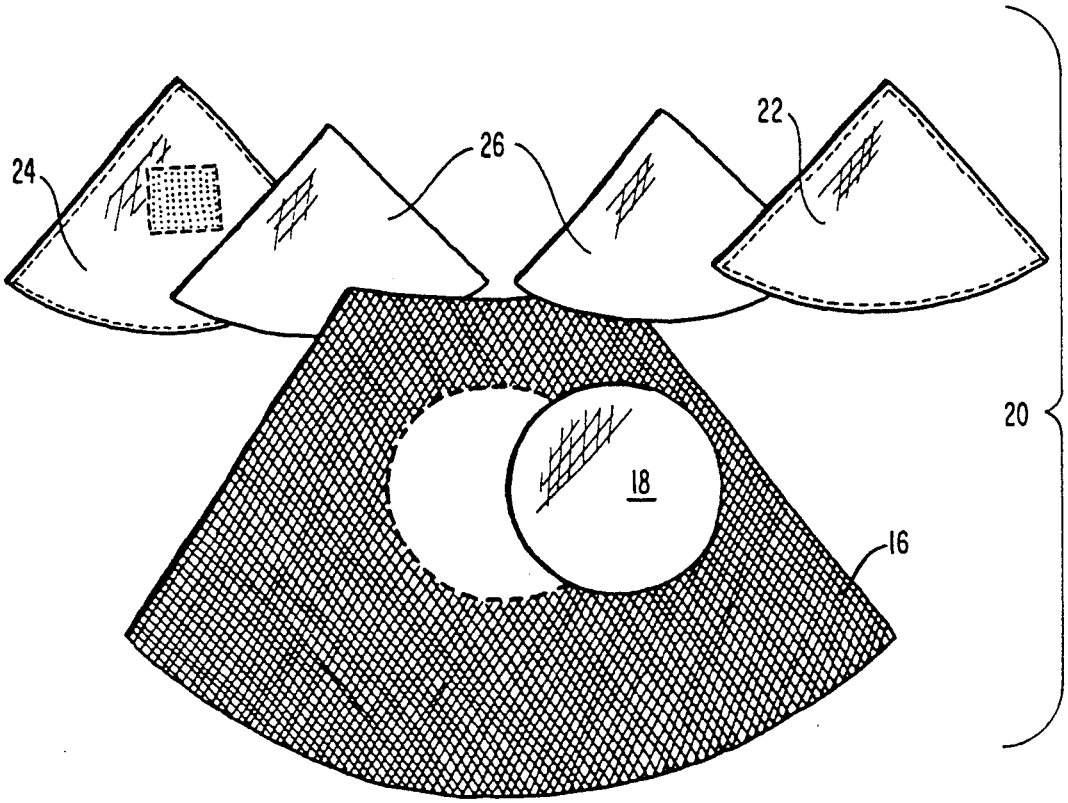
FIG. 2 is an exploded view of the front cover.

The preferred embodiment of the invention 10 is illustrated as worn on a standing, active mother 12 in FIG. 1. The garment of the invention 10 comprises two primary parts, namely a cover 20 and a shoulder engaging clip 28 illustrated in further detail in FIGS. 3A, 3B, 4, 5A and 5B.

Triangularly-shaped cover 20 comprises a soft, firm extension pad 14 with an extending breathable fabric 16.

Extension pad 14 is located at the top corner or apex of the cover 20 and comprises two triangularly-shaped sections of fusible batting 26, which provide for strength, covered by two identical front and back fabric sections 22 and 24. Fabric sections 22 and 24 are preferably made of a sport type knit material of approximately 50% Dacrone® polyester and 50% combed cotton, such as fabric number 3934 available from SoFro Fabrics. The purpose of extension pad 14 is to aid in spreading the cover 20 thereby giving the mother 12 greater concealment. Breathable fabric 16 encourages the flow and circulation of free air to the mother 12 and child 38, thereby keeping both relatively cool. Breathable fabric 16 is preferably a poly-cotton mesh of approximately 50% polyester and 50% cotton such as fabric number 7413 available from SoFro Fabrics.

Because the cover 20 is breathable, it is also, therefore, relatively see-through and transparent. A privacy cover or section 18 is located approximately in the center of the cover 20 and positionable over the bare breast to conceal the infant when nursing. Privacy cover 18 is preferably made from an opaque material such as the bib materials available from SoFro Fabrics.

Shoulder clip 28 is generally not visible to a third party observer when in use such as illustrated in FIG. 1. Shoulder clip 28 is especially useful for active, mobile and occasionally standing mothers because it keeps the cover 20 from shifting.

Figure 3A:
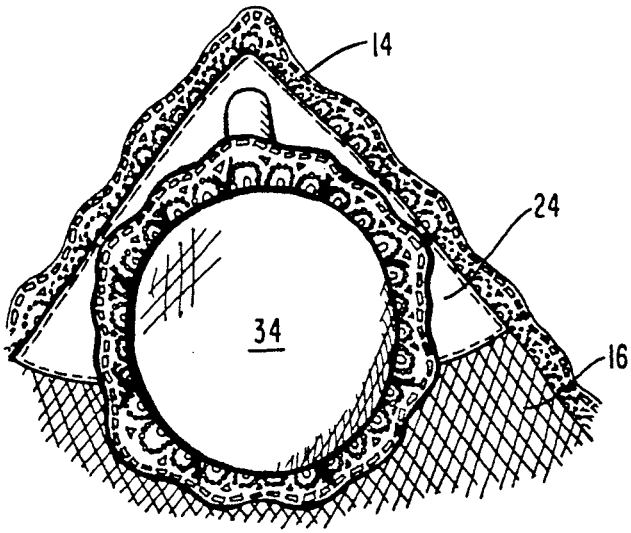
FIG. 3A is a rear elevation view of the shoulder clip attached to the extension pad of the cover.
Figure 3B:
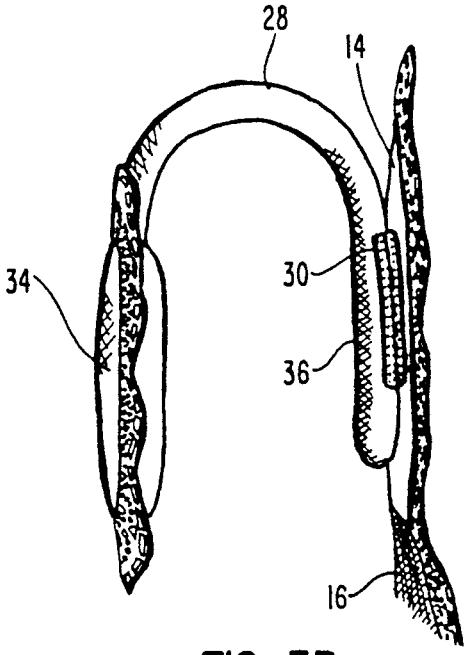
FIG. 3B is a side elevation view of the shoulder clip attached to the extension pad of the cover.
Figure 4:
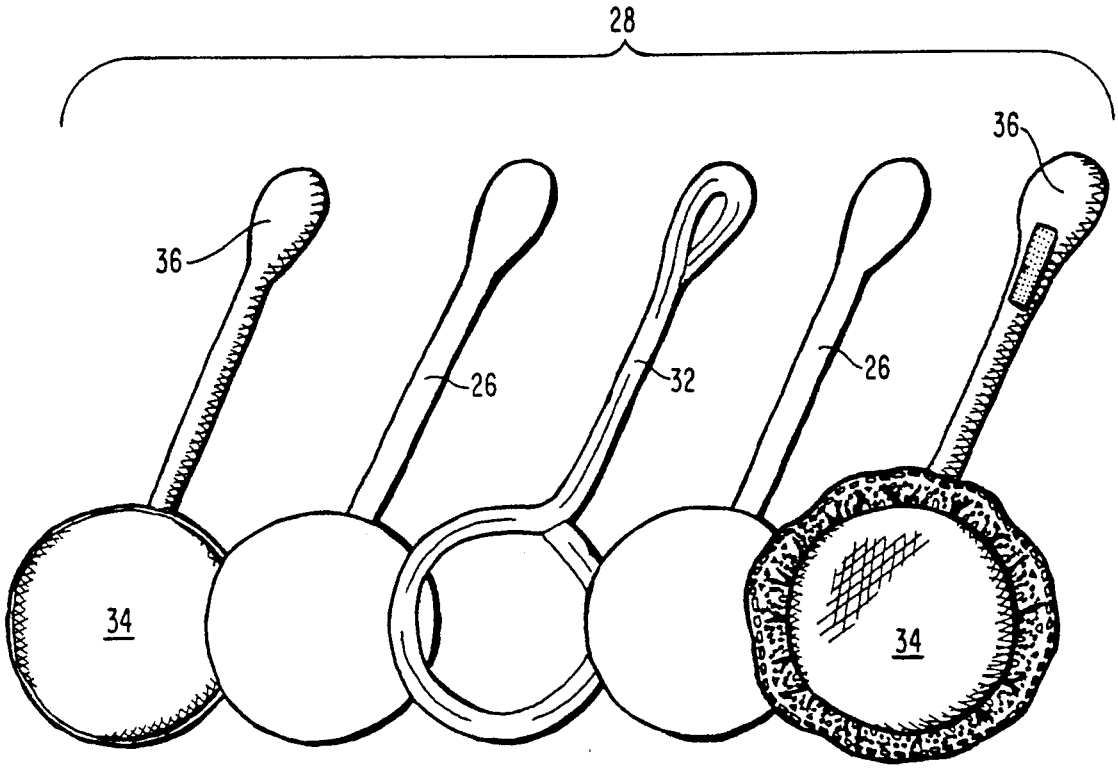
FIG. 4. is an exploded view of the shoulder clip.
Figure 5A:
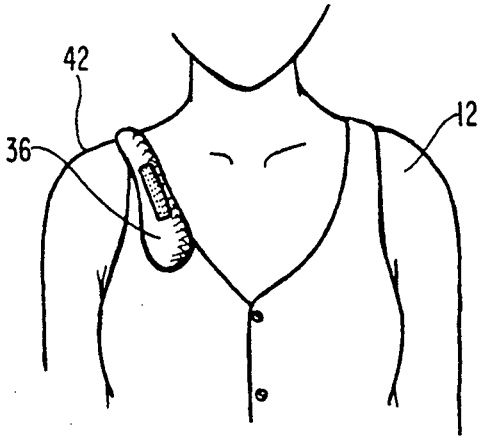
FIG. 5A is a front view of the shoulder clip worn over the right shoulder of a mother without the cover attached.
Figure 5B:
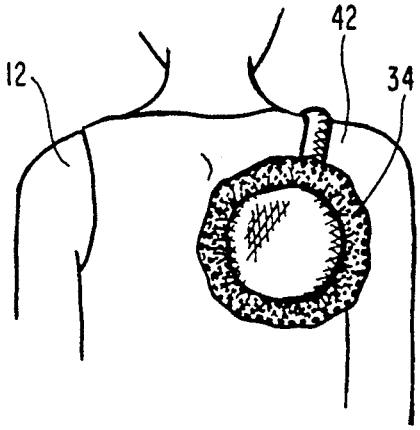
FIG. 5B is a rear view of the shoulder clip attached to the right shoulder of a mother.

Shoulder clip 28 includes a front engaging section 36 as illustrated in FIGS. 3B and 5A connected to a rear shoulder engaging portion 34 as illustrated in FIGS. 3A and 5B. Front shoulder engaging section 36 extends over the shoulder 42 of the mother 12 and down to an area approximately on the same elevation as the top of the breast. A pliable, deformable wire 32 covered by two sections of fusible batting 26 is enclosed by the fabric that forms the rear shoulder engaging section 34 and the front shoulder engaging section 36. The pliable, deformable wire 32 has a total length of approximately 15½ inches and is easily manipulated by the mother 12 so that it conforms to and fits the contours of the shoulder 42. The rear shoulder engaging section 34 has a diameter of approximately 5½ inches. The front shoulder engaging section 36 has a folded width of approximately 2 inches. The length between the front shoulder engaging section 36 and the rear shoulder engaging section 34 is approximately 10 inches. It would be appreciated by those of ordinary skill in the art that these dimensions may be varied slightly without affecting the functionality of the shoulder clip 28. The wire 32 may be made of metal or any other suitable deformable material such as plastic. An especially suitable material comprises an interior type 12 gauge plastic or rubber insulated wire having two strands plus a ground (type 12-2 NM-B) and pliability of 0 to 180 degrees. Other materials may also be suitable.

When in use, the mother 12 first places the shoulder clip 28 over her shoulder 42. She uses her hands to bend the internal wire 32 so that it conforms comfortably and moderately snugly to the topology of the shoulder 42. Once the shoulder clip 28 is comfortably and firmly attached to the shoulder 42, the mother 12 then attaches the hook and loop fastener 30 so as to engage the extension pad portion 14 of the cover 20 to the front shoulder engaging portion 36 of the shoulder clip 28. The hook and loop fastener 30 preferably comprises a Velcro® material but other materials, such as snap fasteners, are possible though less preferable. The mother 12 carefully positions the extension pad 14 so that it spreads the breathable portion 16 of the cover 20 to provide for maximum concealment. It is also important that the privacy cover 18 be located over the area of the breast where the infant 38 is to nurse. As shown in FIG. 1, once the cover 20 is properly attached to the clip 28, the child 38 is virtually totally concealed from the public. The spreading action of the extension pad 14 helps to insure that the cover 20 will stay in position when the mother 12 moves around. Moreover, the shoulder clip 28, because it is firmly attached to the shoulder 42 of the mother 12, will guarantee that the cover 20 will not move from its position and will stay relatively stable during normal activities.

Cover 20 can be easily released from the clip 28 by disengaging the hook and loop fasteners 30. It is then possible to separately wash the cover 20 apart from the clip portion 28 of the garment 10.

When not in use, the cover 20 and the clip 28 can be rolled up and stored in a carrying bag 40. The steps of the technique are illustrated in FIGS. 6A–E. Carrying bag 40 is preferably made of a material consisting of approximately 50% Fortrel® and 50% poly-cotton such as fabric number 3157 available from SoFro Fabrics.

Figure 6A:
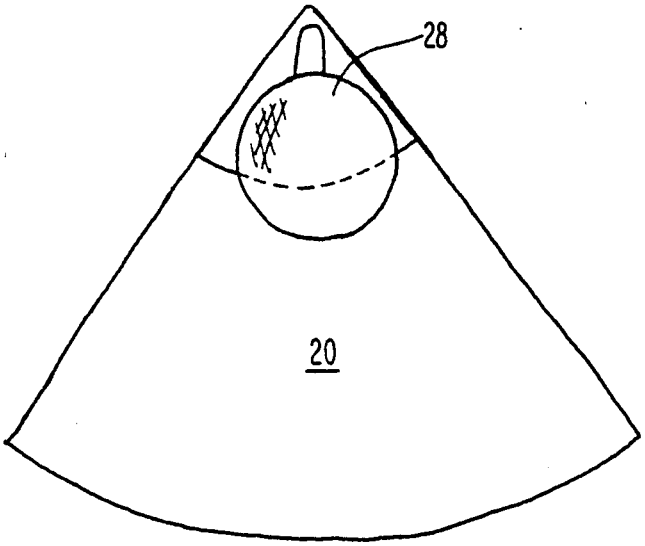
FIG. 6A is a rear view of the breast-feeding cover spread out prior to folding.
Figure 6B:
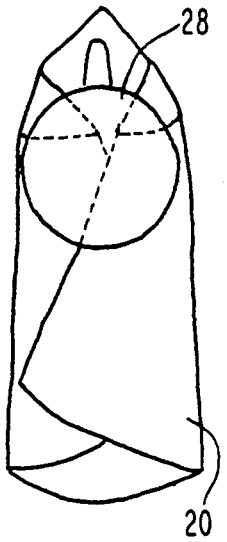
FIG. 6B is a rear view of the cover and clip illustrating the first step of preparing the garment for storage wherein the cover is folded in thirds lengthwise.
Figure 6C:
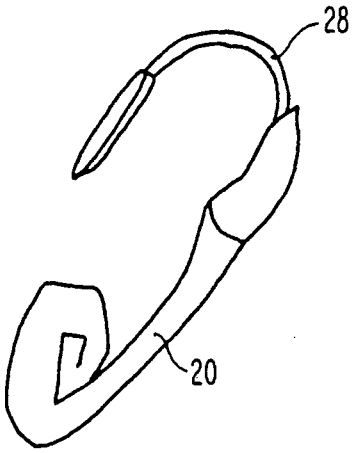
FIG. 6C is a side view of the cover and clip showing the next step in which the bottom portion of the cover is partially folded over and rolled up into the shoulder clip.
Figure 6D:
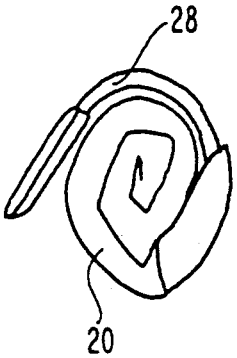
FIG. 6D is a side view of the cover and clip shown with the cover rolled up entirely into the shoulder clip.
Figure 6E:
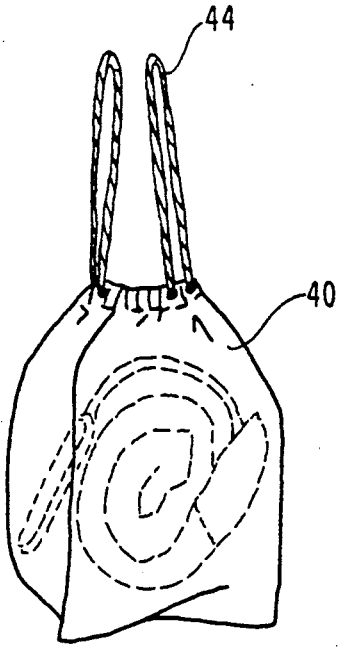
FIG. 6E is a perspective view of the folded and rolled breast-feeding garment shown in phantom lines and encased in its carry-along bag.

Initially, the clip 28 attached to the cover 20 is spread out as shown in FIG. 6A. In the next step, the sides of the triangularly-shaped cover 20 are folded over each other in thirds as shown in FIG. 6B. According to the next step, the end of the cover 20 furthest from the clip 28 is rolled up in the direction of the clip 28 as shown in FIG. 6C and the process is continued until the cover 20 is totally rolled up into the clip 28 as shown in FIG. 6D. In this position, the cover 20 and clip 28 combination can be placed into bag 40 which includes a closure string 44. The bag 40 can then be tied to stroller, diaper bag, purse or simply carried by hand.

While the invention has been described with reference to the preferred embodiment thereof, it would be appreciated by those of ordinary skill in the art that modifications can be made to the parts that comprise the invention without departing from the spirit and scope of the invention as a whole.

I claim:

1. A nursing garment apparatus to be worn over the shoulder of a woman while breast-feeding a baby, said apparatus comprising:

a cover for covering at least one breast of said woman;

a deformable clip means for engaging the shoulder of said woman, said clip means including a back engaging portion including a pad for contacting the back of said shoulder, a front engaging portion for contacting the front of said shoulder, and a pliable, deformable wire for connecting said front and back engaging portions to each other, said wire located inside of said front and back shoulder engaging portions; and, a releasable fastener means for selectively attaching said clip means to said cover, said releasable fastener means comprising hook and loop material, wherein said clip means can be bent to conform to the shape of said shoulder and said front engaging portion engages the back of said should and said front engaging portion engages the front of said shoulder and wherein said cover can be releasably connected to said clip means by said releasable fastener means.

2. The apparatus of claim 1 wherein said cover has at least one corner and further comprises:

an extension pad means attached to one of said corners for spreading said cover and for supporting said fastener means, wherein said extension pad causes said cover to spread.

3. The apparatus of claim 2 wherein said cover rises a breathable fabric.

4. The apparatus of claim 3 wherein said cover further comprises:

a privacy portion attached to said breathable fabric for covering a nursing baby when said apparatus is in use.

5. The apparatus of claim 4 further comprising:

a bag for holding and transporting said cover and clip means when said apparatus is not in use.

6. A nursing garment apparatus to be worn over the shoulder of a woman while breast-feeding a baby, said apparatus comprising:

a cover for covering at least one breast of said woman;

a deformable clip means for engaging the shoulder of said woman, said clip means including a back engaging portion for contacting the back of said shoulder, a front engaging portion for contacting the front of said shoulder, and a pliable, deformable means for connecting said front and back engaging portions to each other; and, a releasable fastener means for selectively attaching said clip means to said cover;

wherein said clip means can be bent to conform to the shape of said shoulder and said front engaging portion contacting the front of said shoulder and said back engaging portion contacting the back of said shoulder and wherein said cover can be selectively attached to said clip means by said releasable fastener means.

* * * * *